US007004001B2

(12) United States Patent
Barnes

(10) Patent No.: US 7,004,001 B2
(45) Date of Patent: Feb. 28, 2006

(54) ROLL FORMING APPARATUS FOR FORMING SHEET MATERIAL INTO MULTIPLE SHAPES

(75) Inventor: Benjamin A. Barnes, Chesterland, OH (US)

(73) Assignee: Formcek Cleveland, Inc., Cleveland, OH (US)

( * ) Notice: Subject to any disclaimer, the term of this patent is extended or adjusted under 35 U.S.C. 154(b) by 123 days.

(21) Appl. No.: 10/374,887

(22) Filed: Feb. 26, 2003

(65) Prior Publication Data

US 2004/0163437 A1 Aug. 26, 2004

(51) Int. Cl.
*B21D 5/08* (2006.01)

(52) U.S. Cl. ..... 72/181; 72/226

(58) Field of Classification Search ..... 72/181, 72/182, 226, 176
See application file for complete search history.

(56) References Cited

U.S. PATENT DOCUMENTS 4,070,887 A * 1/1978 Hankin ..... 72/52
4,558,577 A * 12/1985 Trishevsky et al. ..... 72/12.7
RE35,066 E 10/1995 Martin
5,644,942 A 7/1997 Bradbury
5,647,241 A * 7/1997 Ruple et al. ..... 72/178
5,755,131 A 5/1998 Voth
5,823,036 A * 10/1998 Matsunaga ..... 72/181
5,829,294 A 11/1998 Bradbury et al.
5,829,295 A 11/1998 Voth et al.
5,946,961 A * 9/1999 Stone ..... 72/178
5,970,764 A 10/1999 Surina
5,983,691 A 11/1999 Voth et al.
6,148,654 A 11/2000 Jensen et al.
6,205,898 B1 3/2001 Surina
6,209,374 B1 4/2001 Bradbury et al.
6,216,514 B1 4/2001 Bradbury et al.
6,280,708 B1 * 8/2001 Ryles et al. ..... 424/53
6,282,932 B1 9/2001 Surina et al.
6,434,994 B1 8/2002 Bradbury et al.

FOREIGN PATENT DOCUMENTS

JP SHOWA 47-37833 9/1972
JP 58-181428 * 10/1983 ..... 72/181
JP 60-61119 * 4/1985 ..... 72/181

* cited by examiner

*Primary Examiner*—Daniel C. Crane
(74) *Attorney, Agent, or Firm*—Canton Colburn LLP

(57) ABSTRACT

A roll forming apparatus includes at least one convertible roller assembly. The convertible roller assembly includes a support plate rotatably mounted on a shaft. The support plate includes at least one roller. The support plate may be toggled by an actuator from a first position for forming C shaped members to a second position for forming Z shaped members.

15 Claims, 9 Drawing Sheets

ROLL FORMING APPARATUS FOR FORMING SHEET MATERIAL INTO MULTIPLE SHAPES

BACKGROUND OF THE INVENTION

1. Field of Invention

The invention relates generally to forming sheet material and in particular to a method and system for forming sheet material into multiple shapes.

2. Description of Related Art

Roll forming machines are used to form sheet material, such as steel, into structural elements. Common structural elements include C-shaped purlins and Z-shaped purlins such as those shown in FIGS. 1 and 2. The C-shaped purlins and Z-shaped purlins include a central section 10, legs 12 and lips 14. Other exemplary structural elements formed from sheet material include open C purlins, cave struts, etc.

It is desirable to form both C-shaped and Z-shaped members on a single machine. Attempts have been made to provide adjustable machines that convert from a C forming configuration to a Z forming configuration. One example is disclosed in U.S. Pat. No. 5,829,294 which discloses a roll former line in which a roll stand having three rollers is adjusted up and down in order to convert between C forming and Z forming configurations. A drawback to such designs is the time required to convert the machine from C forming to Z forming configuration. Thus, there is a need in the art for a convertible roll forming apparatus requiring little setup time.

SUMMARY OF THE INVENTION

A roll forming apparatus includes at least one convertible roller assembly. The convertible roller assembly includes a support plate rotatably mounted on a shaft. The support plate includes at least one roller. The support plate may be toggled by an actuator from a first position for forming C shaped members to a second position for forming Z shaped members.

DETAILED DESCRIPTION OF INVENTION

Figure 2:
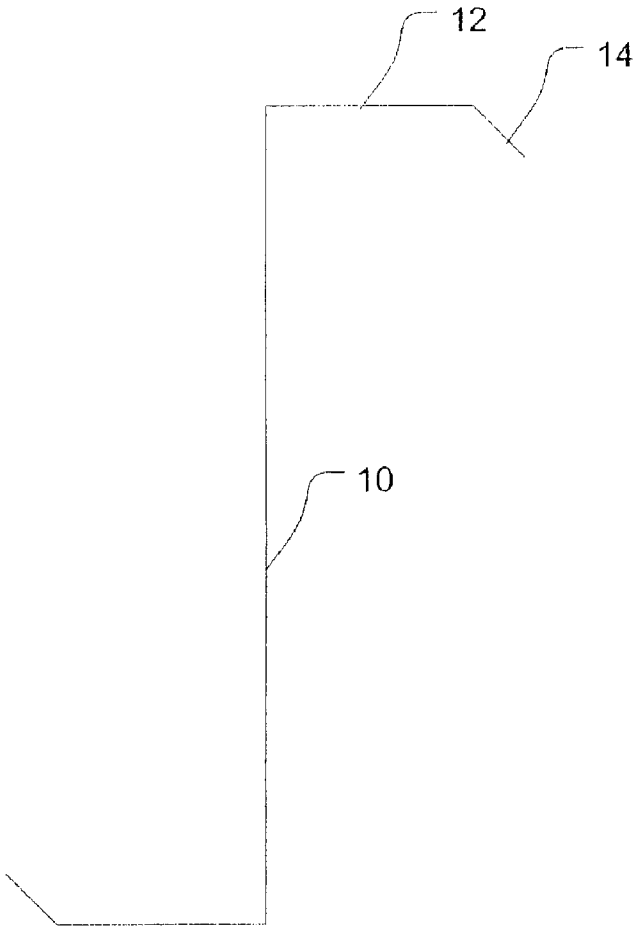
FIG. 2 illustrates a conventional Z-shaped purlin.
Figure 1:
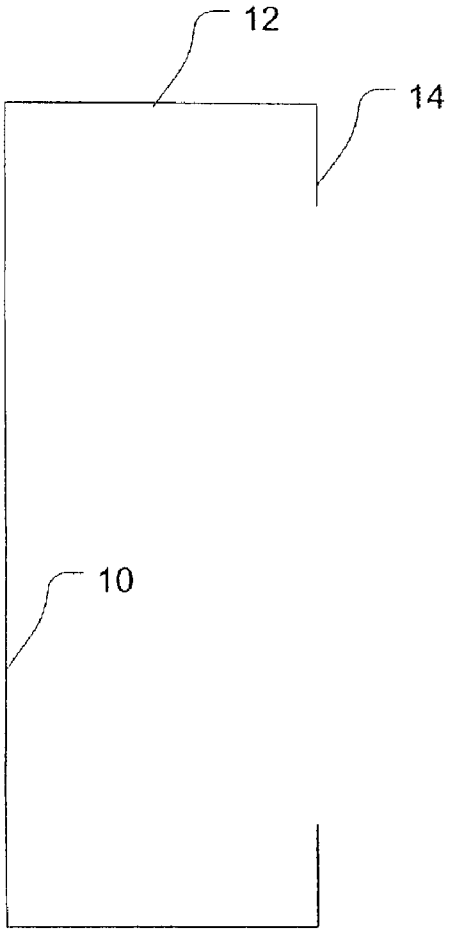
FIG. 1 illustrates a conventional C-shaped purlin.

The invention relates to a roll forming apparatus configurable to form multiple shapes of structural elements from sheet material. In a typical application, the roll forming apparatus forms sheet metal into C-shaped or Z-shaped members, such as those shown in FIGS. 1 and 2. The initial step in forming either a C-shaped member or Z-shaped member is to form the lips 14.

Figure 3:
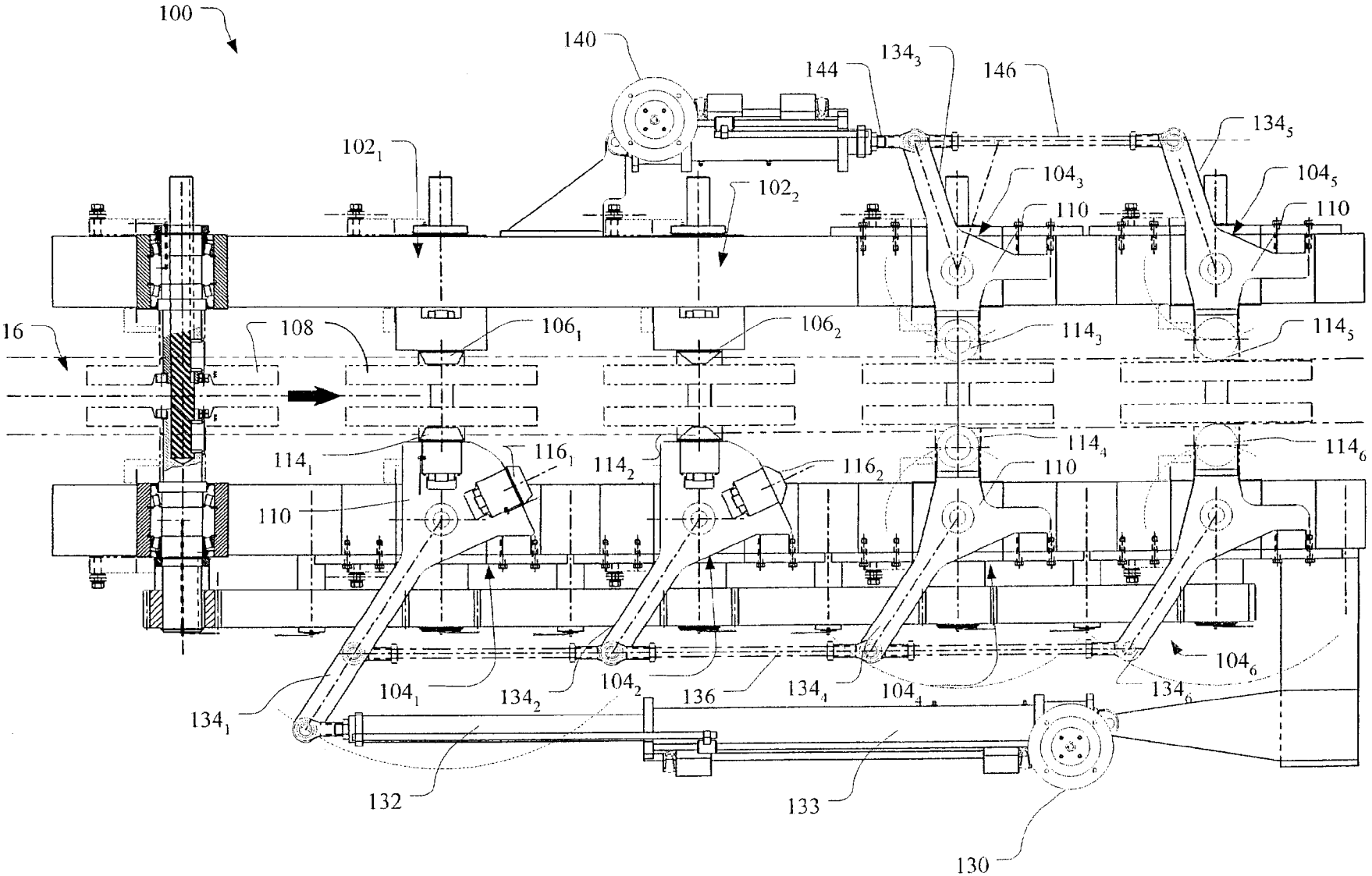
FIG. 3 is a top view of a lip forming apparatus in a C forming configuration.
Figure 4:
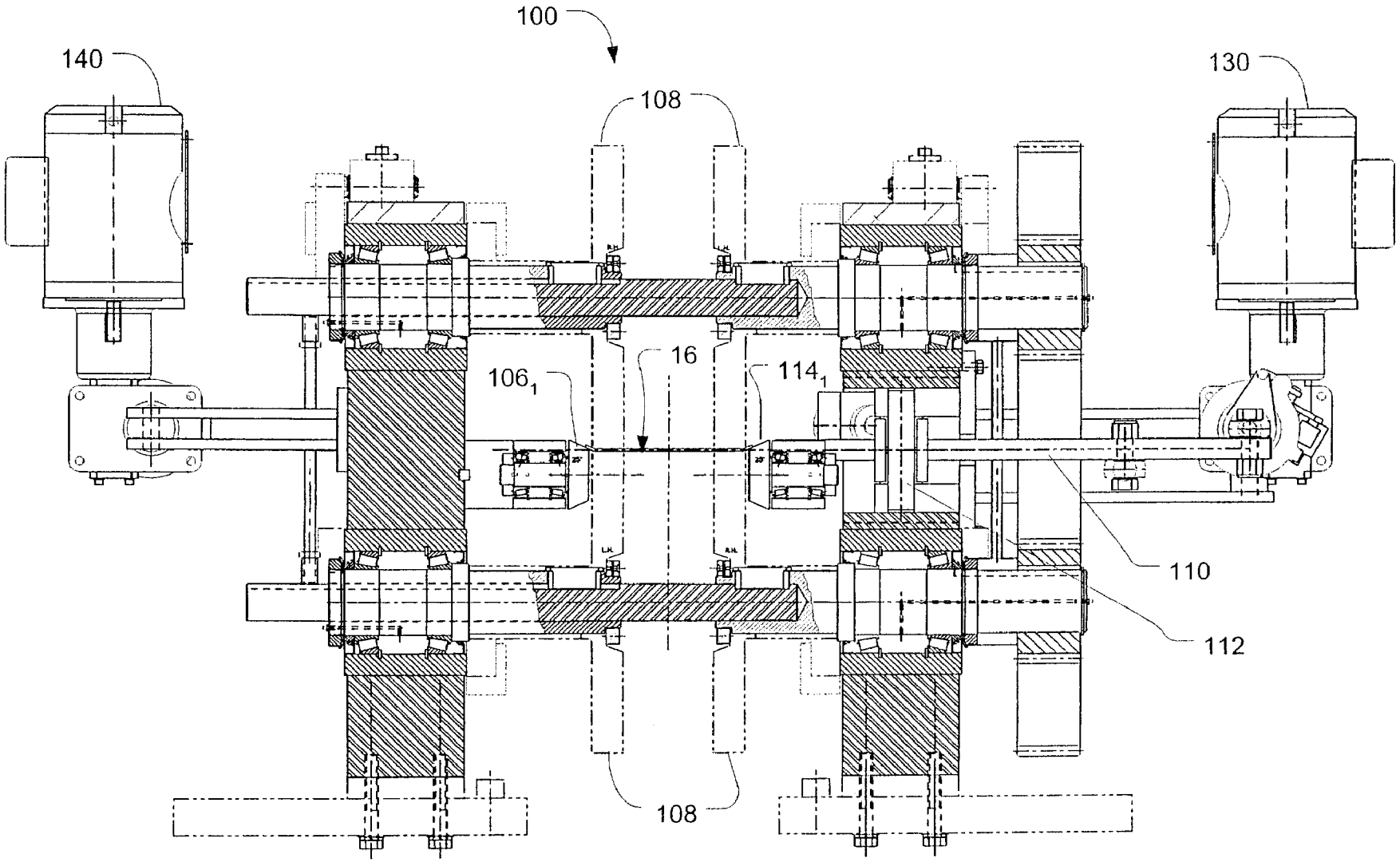
FIG. 4 is an end cross-sectional view of the lip forming apparatus of FIG. 3.

FIG. 3 is a top view of a lip forming apparatus 100 and FIG. 4 is a cross-sectional end view of FIG. 3. The lip forming apparatus 100 includes fixed roller assemblies 102 and convertible roller assemblies 104, for forming lips 14 on sheet material 16. The distance between the roller assemblies on either side of sheet material 16 can be adjusted to accommodate different widths of sheet material and form lips of various lengths as known in the art.

The fixed roller assemblies 102 include a lip roller 106 rotatably mounted on a shaft within a housing having suitable bearings to allow rotation of the lip roller 106. The lip roller 106 is positioned to contact sheet material 16 on a first side (e.g., the bottom) of the sheet material 16. Drive rollers 108 make contact with the first and second sides of sheet material 16 and guide the sheet material 16 over lip rollers 106. Lip rollers $\mathbf{106}_1$ and $\mathbf{106}_2$ have outer surfaces angled with respect to the plane of the central section 10 of sheet material 16. For example, lip roller $\mathbf{106}_1$ may have an angle of 25 degrees with respect to the plane of central section 10 of sheet material 16. Lip roller $\mathbf{106}_2$ may have an angle of 50 degrees with respect to the plane of the central section 10 of sheet material 16. As the drive rollers 108 move sheet material 16 over the lip rollers 106, a lip 14 is formed as shown in FIG. 4.

The convertible roller assemblies 104 include a support plate 110 that may be toggled between a C forming position and a Z forming position. Support plate 110 is rotatably mounted on shaft 112 to allow free rotation of support plate 110. In at least one position (i.e., C forming or Z forming) a roller contacts the sheet material 16. The convertible roller assemblies 104 include at least one of a C lip roller 114 and a Z lip roller 116. Both the C lip roller 114 and the Z lip roller 116 are mounted on a shaft within a housing having suitable bearings to allow rotation.

The C lip roller 114 and Z lip roller 116 are mounted on support plate 110 so as to contact opposite sides of sheet material 16. When the convertible roller assembly $\mathbf{104}_1$ is in a C forming configuration as shown in FIG. 3, the C lip roller $\mathbf{114}_1$ contacts a first side (e.g., bottom) of sheet material 16. This causes the lip 14 to be formed upward as shown in FIG. 4. Conversely, when the convertible roller assembly $\mathbf{104}_1$ is in a Z forming configuration (shown in FIGS. 5 and 6), the Z lip roller $\mathbf{116}_1$ is in contact with the second side (e.g., top) of sheet material 16. This may be achieved by mounting the C lip rollers 114 on the bottom of support plate 110 as shown in FIG. 4 and mounting the Z lip rollers 116 on the top of the support plate 110 as shown in FIG. 6. Alternatively, the C lip rollers 114 and Z lip rollers 116 may be mounted on the same side of support plate 110, with the Z lip roller 116 positioned (e.g., on a spacer) above the C lip roller 114.

As described previously with respect to lip rollers 106, the angle of the C lip roller relative to the central section 10 of the sheet material 16 may increase as the sheet material progresses through the roll forming apparatus. For example, C lip roller $\mathbf{114}_1$ may have an angle of 25 degrees with respect to the central section 10 of the sheet material 16. C lip roller $\mathbf{114}_2$ may have an angle of 50 degrees with respect to the central section 10 of the sheet material 16. C lip rollers $\mathbf{114}_3$ and $\mathbf{114}_4$ may have an angle of 65 degrees with respect to the central section 10 of the sheet material 16. C lip rollers $\mathbf{114}_5$ and $\mathbf{114}_6$ may have an angle of 90 degrees with respect to the central section 10 of the sheet material 16.

C lip rollers $114_1$ and $114_2$ are mounted differently than C lip rollers $114_3$, $114_4$, $114_5$ and $114_6$. C lip rollers $114_1$ and $114_2$ have an axis of rotation that is perpendicular to the longitudinal axis of shaft 112. C lip rollers $114_3$, $114_4$, $114_5$ and $114_6$ have an axis of rotation that is parallel to the longitudinal axis of shaft 112. This allows the same roller to be used in two locations to obtain different bend angles. For example, a roller with a 25 degree outer surface bevel may be used for C lip roller $114_1$ and C lip roller $114_4$.

The convertible roller assemblies 104 may be toggled from C forming configuration (FIGS. 3 and 4) to Z forming configuration (FIGS. 5 and 6) through one or more actuators. Shown in FIG. 3 is an actuator 130 connected to a linkage for simultaneously toggling convertible roller stations $104_1$, $104_2$, $104_4$ and $104_6$ back and forth between C forming mode and Z forming mode. The actuator 130 may be an electrical motor, hydraulic device, pneumatic device etc. Actuator 130 drives a linkage including a piston 132 that moves in and out of sleeve 133. One end of piston 132 is pivotally connected to pivot arm $134_1$ of support plate 110 on convertible roller assembly $104_1$. Pivot arms $134_2$, $134_4$ and $134_6$ are pivotally connected to rod 136 which is also pivotally connected to pivot arm $134_1$. As is apparent, movement of piston 132 will cause pivot arm $134_1$ to rotate thereby causing pivot arms $134_2$, $134_4$ and $134_6$ to rotate. The amount of travel of pivot arms 134 can be controller by actuator 130 and/or by positional stops contacting support plates 110.

Convertible roller assemblies $104_3$ and $104_5$ are toggled by a similar mechanism. An actuator 140 is connected to pivot arms $134_3$ and $134_5$ by a linkage. The fixed roller assemblies 102 provide a location to mount actuator 140 closer to the convertible roller assemblies $104_3$ and $104_5$. Thus, the linkage includes piston 144 and rod 146 pivotally connected to pivot arms $134_3$ and $134_5$. Again, the amount of travel of pivot arms 134 can be controller by actuator 140 and/or by positional stops located on the support plates 110.

FIGS. 3 and 4 show the lip forming apparatus 100 in C forming configuration. As the sheet material 16 passes over rollers 106 and 114, the 90 degree C. lip is formed. FIG. 4 shows fixed roller $106_1$ and C lip roller $114_1$ beginning formation of the lips 14 with a 25 degree bend.

Figure 5:
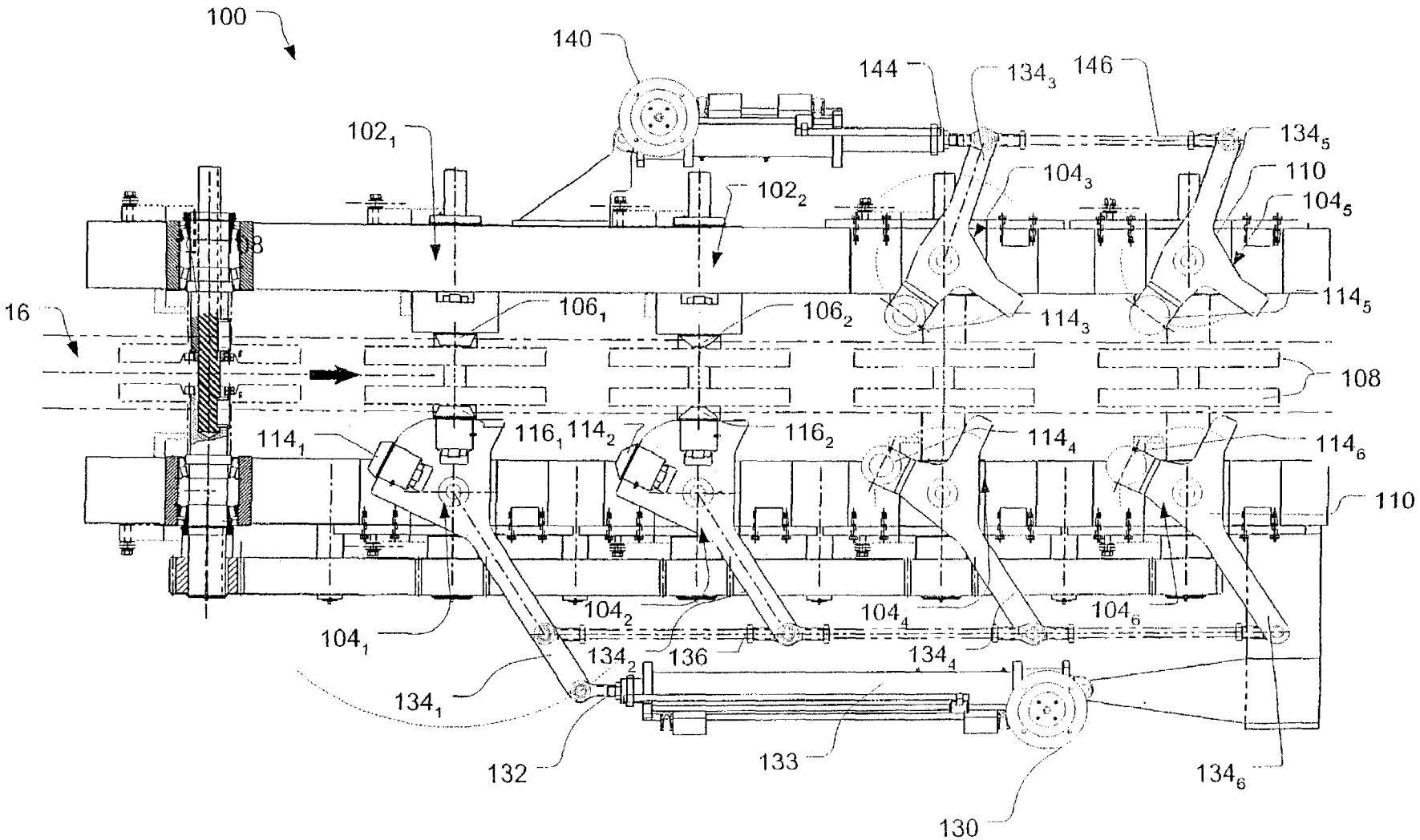
FIG. 5 is a top view of the lip forming apparatus in a Z forming configuration.
Figure 6:
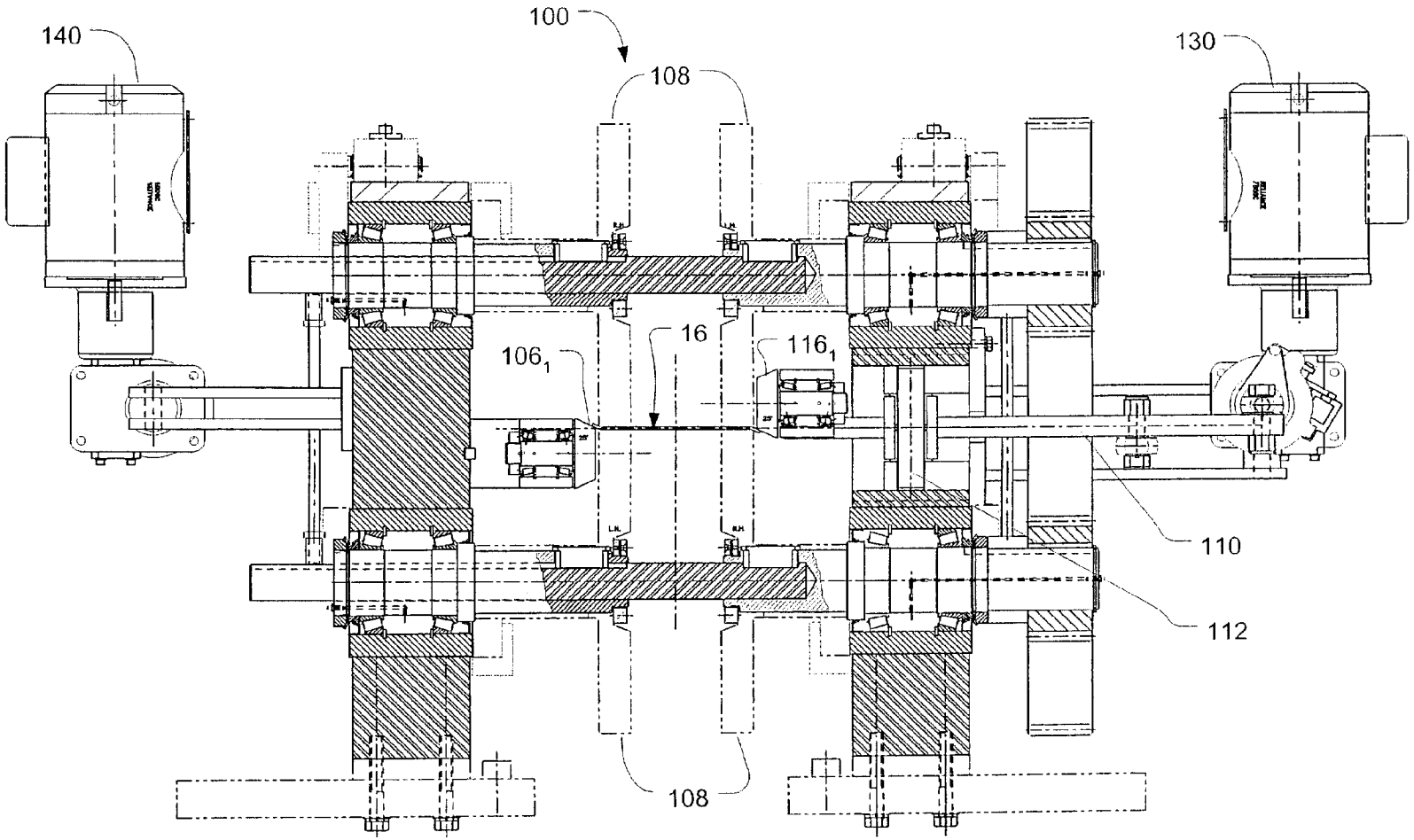
FIG. 6 is an end cross-sectional view of the lip forming apparatus of FIG. 5.

FIGS. 5 and 6 show the lip forming apparatus 100 in a Z forming configuration. As the sheet material 16 passes over rollers 106 and 114, the 50 degree Z lip is formed. As shown in FIG. 5, convertible roller assemblies $104_3$–$104_6$ have no roller contacting sheet material 16 in the Z forming configuration. Thus, the Z lip is formed at 50 degrees by roller $106_2$ and $114_2$. FIG. 6 shows fixed roller assembly $106_1$ and Z lip roller $116_1$ beginning formation of the lips 14 with a 25 degree bend. Evident from FIGS. 4 and 6, the C lip roller $114_1$ and the Z lip roller $116_1$ are positioned on opposite sides of sheet material 16 to achieve the desired C or Z configuration.

Figure 7:
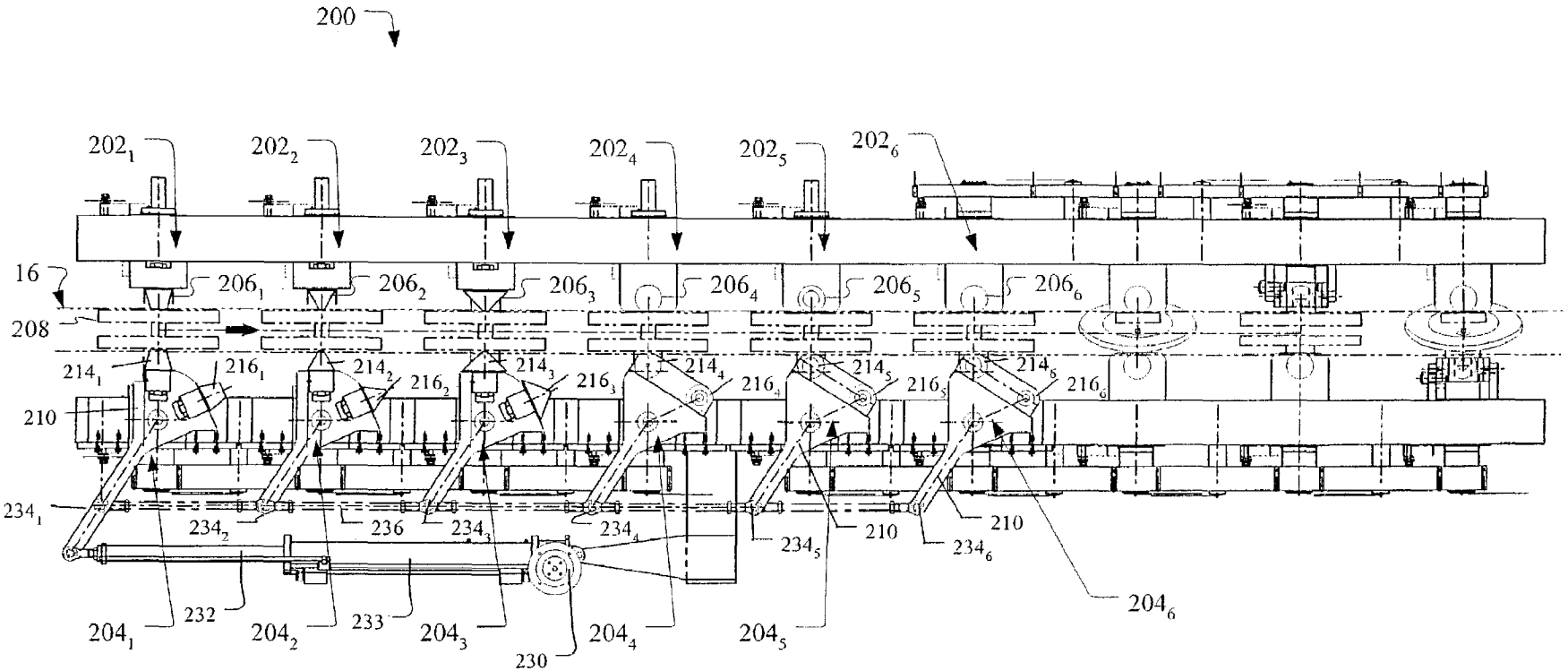
FIG. 7 is a top view of a leg forming apparatus in a C forming configuration.
Figure 8:
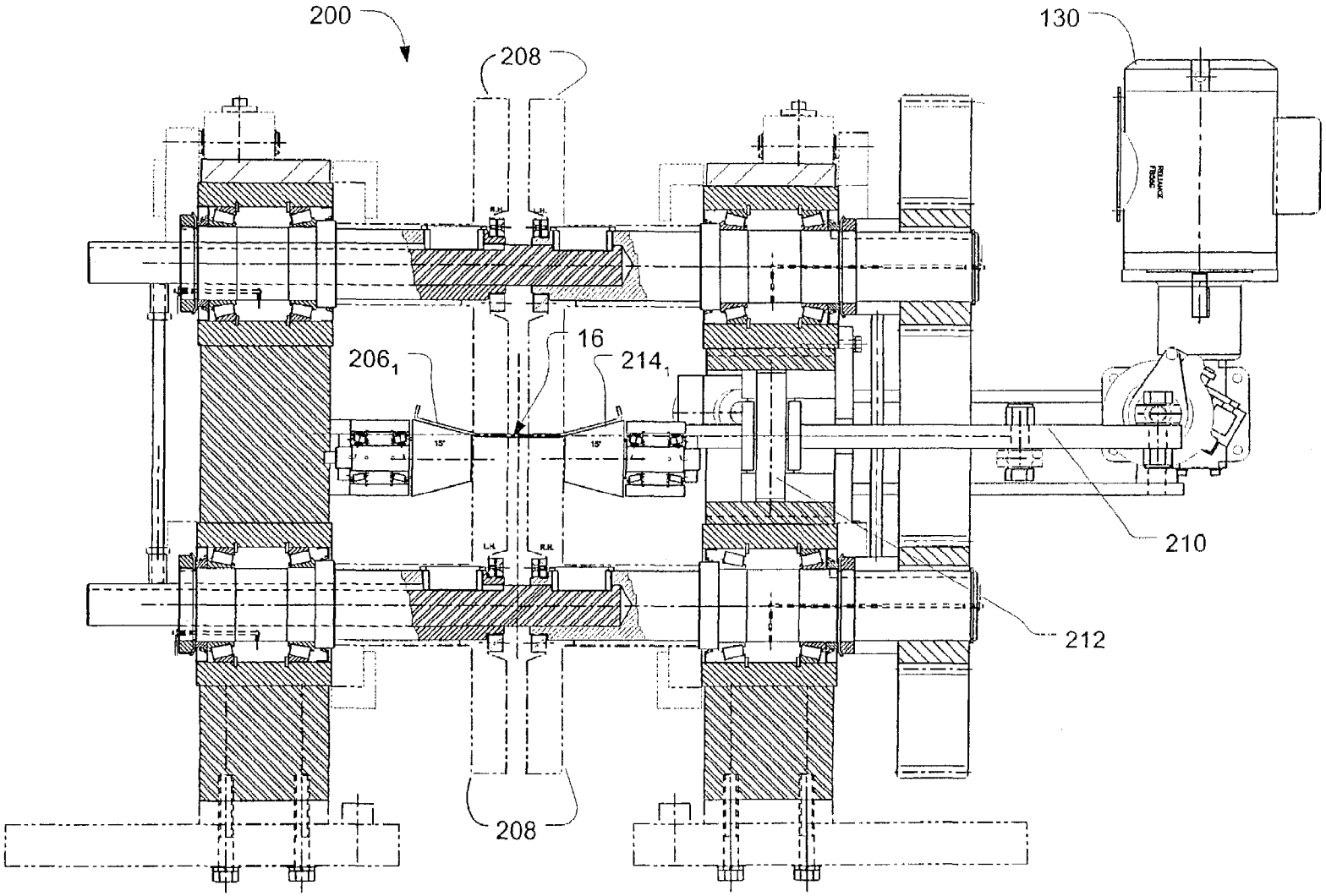
FIG. 8 is an end cross-sectional view of the leg forming apparatus of FIG. 7.

FIG. 7 is a top view of a leg forming apparatus 200 and FIG. 8 is a cross-sectional end view of FIG. 7. The leg forming apparatus 200 includes fixed roller assemblies 202 and convertible roller assemblies 204, for forming legs 14 on sheet material 16. The distance between the roller assemblies on either side of sheet material 16 can be adjusted to accommodate different widths of sheet material and form legs of various lengths as known in the art.

The fixed roller assemblies 202 include a leg roller 206 rotatably mounted on a shaft within a housing having suitable bearings to allow rotation of the leg roller 206. The leg roller 206 is positioned to contact sheet material 16 on a first side (e.g., the bottom) of the sheet material. Drive rollers 108 make contact with the first and second sides of the sheet material 16 and guide the sheet material 16 over leg rollers 206. Leg rollers $206_1$ through $206_6$ have outer surfaces angled with respect to the plane of the center of sheet material 16. For example, leg roller $206_1$ may have an angle of 15 degrees with respect to the plane of the central section of sheet material 16. Leg roller $206_2$ may have an angle of 30 degrees with respect to the plane of the central section of sheet material 16. As the drive rollers 108 move the sheet material over the leg rollers 206, a leg 12 is formed as shown in FIG. 8.

The convertible roller assemblies 204 include a support plate 210 that may be toggled between a C forming position and a Z forming position. Support plate 210 is rotatably mounted on shaft 212 to allow free rotation of support plate 210. In at least one position (i.e., C forming or Z forming) a roller contacts the sheet material 16. The convertible roller assemblies 204 include at least one of a C leg roller 214 and a Z leg roller 216. Both the C leg roller 214 and the Z leg roller 216 are mounted on a shaft within a housing having suitable bearings to allow rotation.

The C leg roller 214 and Z leg roller 216 are mounted on support plate 210 so as to contact opposite sides of the sheet material. When the convertible roller assembly $204_1$ is in a C forming configuration as shown in FIG. 7, the C leg roller $214_1$ contacts a first side (e.g., bottom) of sheet material 16. This causes the leg to be formed upward as shown in FIG. 8. Conversely, when the convertible roller assembly $204_1$ is in a Z forming configuration (shown in FIGS. 9 and 10), the Z leg roller $216_1$ is in contact with the second side (e.g., top) of sheet material 16. This may be achieved by mounting the C leg rollers 214 on the bottom of support plate 210 as shown in FIG. 8 and mounting the Z leg rollers 216 on the top of the support plate 210 as shown in FIG. 10. Alternatively, the C leg rollers 214 and Z leg rollers 216 may be mounted on the same side of support plate 210, with the Z leg roller 216 positioned (e.g., on a spacer) above the C leg roller 214.

As described previously with respect to leg rollers 206, the angle of the C leg roller relative to the central section 10 of the sheet material 16 may increase as the sheet material 16 progresses through the leg forming apparatus 200. For example, C leg roller $214_1$ may have an angle of 15 degrees with respect to the central section 10 of the sheet material 16. C leg roller $214_2$ may have an angle of 30 degrees with respect to the central section 10 of the sheet material 16. C leg roller $214_3$ may have an angle of 45 degrees with respect to the central section 10 of the sheet material 16. C leg roller $214_4$ may have an angle of 60 degrees with respect to the central section 10 of the sheet material 16. C leg roller $214_5$ may have an angle 75 degrees with respect to the central section 10 of the sheet material 16. C leg roller $214_6$ may have an angle of 90 degrees with respect to the central section 10 of the sheet material 16.

C leg rollers $214_4$ through $214_6$ are mounted differently than C leg rollers $214_1$ through $214_3$. C leg rollers $214_1$ through $214_3$ have an axis of rotation that is perpendicular to the longitudinal axis of shaft 212. C leg rollers $214_4$ through $214_6$ have an axis of rotation that is parallel to the longitudinal axis of shaft 212. This allows the same roller to be used in two locations to obtain different bend angles. For example, a roller with a 15 degree outer surface bevel may be used for C leg roller $214_1$ and C leg roller $214_5$.

The convertible roller assemblies 204 may be toggled from C forming configuration (FIGS. 7 and 8) to Z forming configuration (FIGS. 9 and 10) through one or more actuators. Shown in FIG. 7 is an actuator 230 connected to a linkage for simultaneously toggling convertible roller stations $204_1$ through $204_6$ back and forth between C forming mode and Z forming mode. The actuator 230 may be an electrical motor, hydraulic device, pneumatic device etc. Actuator 230 drives a linkage includes a piston 232 that moves in and out of sleeve 233. One end of piston 232 is pivotally connected to pivot arm $234_1$ of support plate 210 on convertible roller assembly $204_1$. Pivot arms $234_2$ through $234_6$ are pivotally connected to rod 236 which is also pivotally connected to pivot arm $234_1$. As is apparent, movement of piston 232 will cause pivot arm $234_1$ to rotate thereby causing pivot arms $234_2$ through $234_6$ to rotate. The amount of travel of pivot arms 234 can be controlled by actuator 230 and/or by positional stops contacting support plates 210. It is understood that actuator 230 and piston 232 may directly drive rod 236 in a manner similar to actuator 140 driving rod 146 in FIG. 3.

FIGS. 7 and 8 show the leg forming apparatus 200 in C forming configuration. As the sheet material 16 passes over rollers 206 and 214, the 90 degree C. legs are formed. FIG. 8 shows fixed roller $206_1$ and C leg roller $214_1$ beginning formation of the legs 12 with a 15 degree bend.

Figure 9:
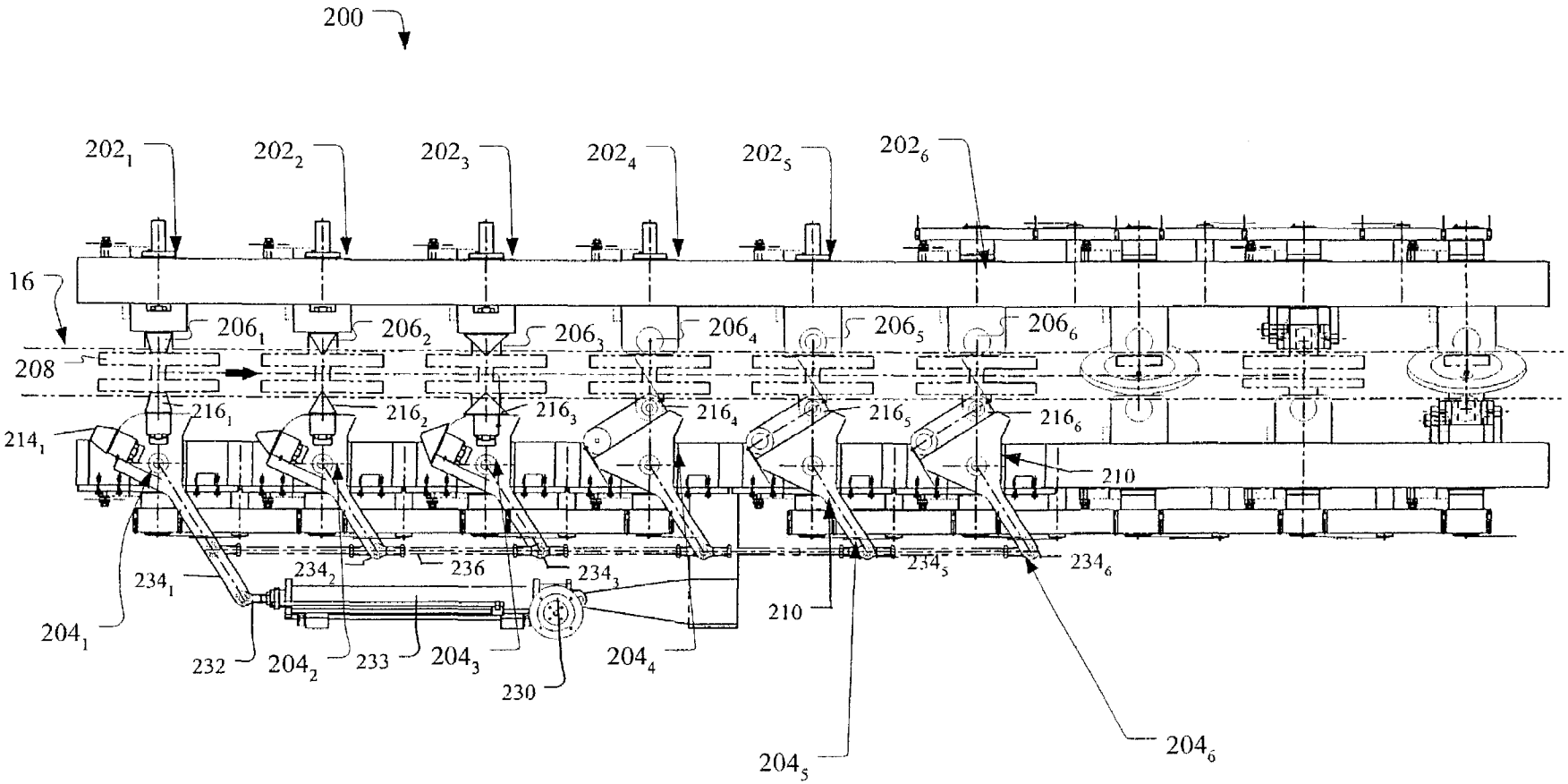
FIG. 9 is a top view of the leg forming apparatus in a Z forming configuration.
Figure 10:
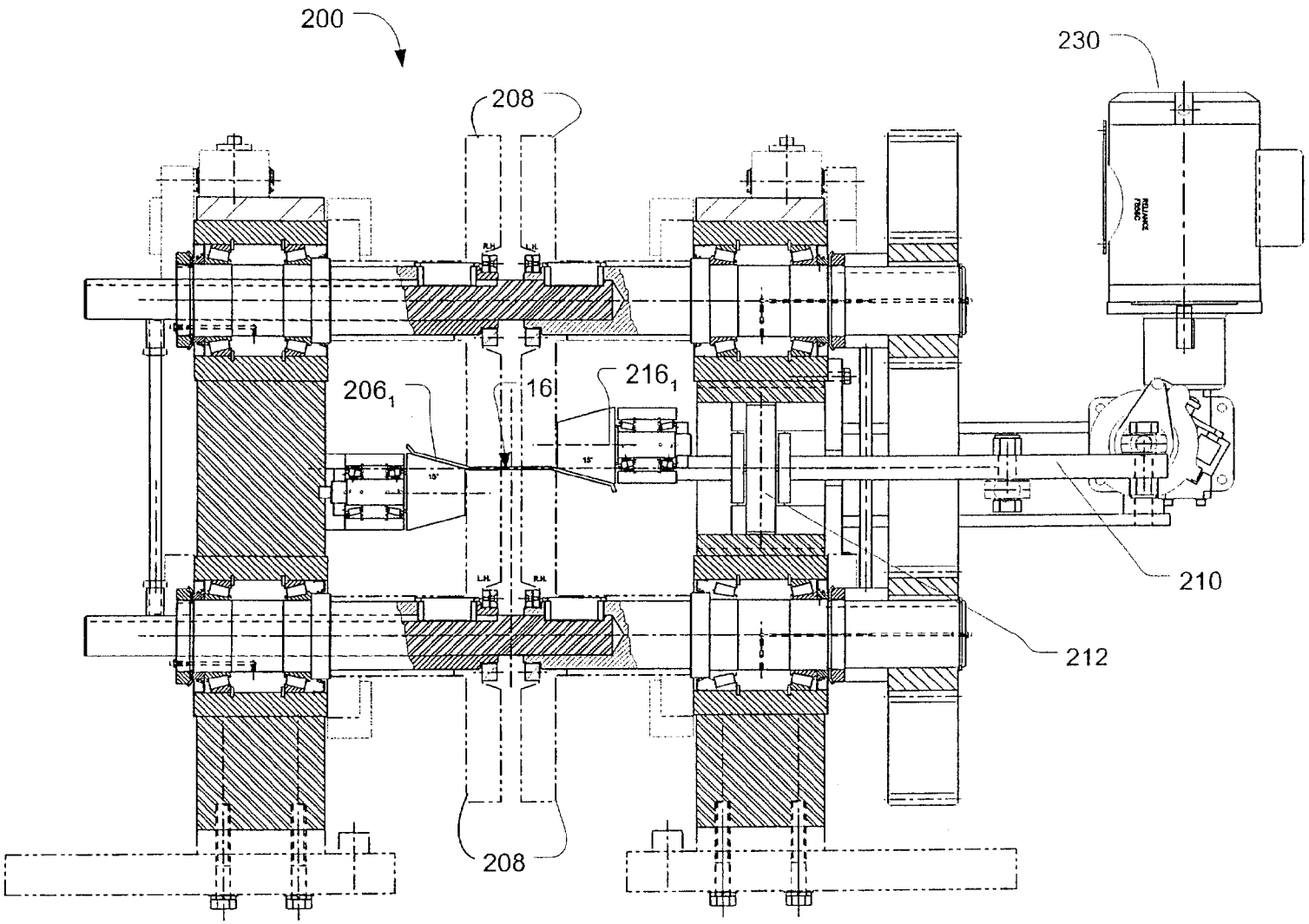
FIG. 10 is an end cross-sectional view of the leg forming apparatus of FIG. 9.

FIGS. 9 and 10 show the leg forming apparatus 200 in a Z forming configuration. As the sheet material 16 passes over rollers 206 and 216, the 90 degree Z legs are formed. FIG. 10 shows fixed roller $206_1$ and Z leg roller $216_1$ beginning formation of the Z legs 12 with a 15 degree bend. Evident from FIGS. 8 and 10, the C leg roller $214_1$ and the Z leg roller $216_1$ are positioned on opposite sides of sheet material 16 to achieve the desired C or Z configuration.

The lip rollers 106, C lip rollers 114, Z lip rollers 116, leg rollers 206, C leg rollers 214 and Z leg rollers 216 may be mounted so as to accommodate different thickness of sheet material. A suitable roller support structure is disclosed in U.S. Pat. No. 6,282,932, the entire contents of which are incorporated herein by reference.

While exemplary embodiments have been shown and described, various modifications and substitutions may be made thereto without departing from the spirit and scope of the invention. Accordingly, it is to be understood that the present invention has been described by way of illustration and not limitation.

What is claimed is:

1. A roll forming apparatus for forming sheet material into multiple shapes, the roll forming apparatus comprising:

a leg forming apparatus having:

a first leg roller assembly having a first leg roller; and a convertible leg roller assembly including:

a support plate pivotally mounted on a shaft;

a first comfiguration leg roller;

an actuator coupled to said support plate by a linkage, said actuator rotating said support plate to bring said first configuration leg roller into a position to contact the sheet material;

wherein said support plate includes a second configuration leg roller, said actuator toggling said support plate to bring first configuration leg roller or said second configuration leg roller into a position to contact the sheet material;

wherein said first configuration leg roller is a C leg roller and said second configuration leg roller is a Z leg roller.

2. The roll forming apparatus of claim 1 wherein:

first configuration leg roller is on a first side of said support plate and said second cofiguration leg roller is on a second side of said support plate.

3. The roll forming apparatus of claim 1 wherein:

said first roller assembly is fixed roller assembly.

4. The roll forming apparatus of claim 1 further comprising:

a lip forming apparatus having:

a first lip roller assembly having a first lip roller; and a convertible lip roller assembly opposite said first lip roller assembly;

said convertible lip roller assembly including:

a lip roller support plate pivotally mounted on a shaft;

a first configuration lip roller;

a second actuator coupled to said lip roller support plate by a second linkage, said second actuator rotating said lip roller support plate to bring said first configuration lip roller into a position to contact the sheet material.

5. A roll forming apparatus for forming sheet material into multiple shapes, the roll forming apparatus comprising:

a leg forming apparatus having:

a first leg roller assembly having a first leg roller; and a convertible leg roller assembly including:

a support plate pivotally mounted on a shaft;

a first configuration leg roller;

an actuator coupled to said support plate by a linkage, said actuator rotating said support plate to bring said first configuration leg roller into a position to contact the sheet material;

wherein said support plate includes a second configuration leg roller, said actuator toggling said support plate to bring one of said first configuration leg roller or said second configuration leg roller into a position to contact the sheet material;

wherein said first leg roller is positioned on a first side of the sheet material and said first configuration leg roller is on said first side of the sheet material.

6. The roll forming apparatus of claim 5 wherein:

first configuration leg roller is on a first side of said support plate and said second configuration leg roller is on a second side of said support plate.

7. The roll forming apparatus of claim 5 wherein:

said first roller assembly is fixed roller assembly.

8. The roll forming apparatus of claim 5 further comprising:

a lip forming apparatus having:

a first lip roller assembly having a first lip roller; and a convertible lip roller assembly opposite said first lip roller assembly;

said convertible lip roller assembly including:

a lip roller support plate pivotally mounted on a shaft;

a first configuration lip roller;

a second actuator coupled to said lip roller support plate by a second linkage, said second actuator rotating said lip roller support plate to bring said first configuration lip roller into a position to contact the sheet material.

9. A roll forming apparatus for forming sheet material into multiple shapes, the roll forming apparatus comprising:

a leg forming apparatus having:

a first leg roller assembly having a first leg roller; and a convertible leg roller assembly including;

a support plate pivotally mounted on a shaft;

a first configuration leg roller;

an actuator coupled to said support plate by a linkage, said actuator rotating said support plate to bring said first configuration leg roller into a position to contact the sheet material;

wherein said support plate includes a second configuration leg roller, said actuator toggling said support plate to bring first configuration leg roller or said second cofiguration leg roller into a position to contact the sheet material;

wherein said first leg roller is positioned on a first side of the sheet material, said first configuration leg roller is on said first side of the sheet material and said second configuration roller is on a second side of the sheet material.

10. The roll forming apparatus of claim 9 wherein:

first configuration leg roller is on a first side of said support plate and said second configuration leg roller is on a second said of said support plate.

11. The roll forming apparatus of claim 9 wherein:

said first roller assembly is fixed roller assembly.

12. The roll forming apparatus of claim 9 further comprising:

a lip forming apparatus having:

a first lip roller assembly having a first lip roller; and a convertible lip roller assembly opposite said first lip roller assembly;

said convertible lip roller assembly including:

a lip roller support plate pivotally mounted on a shaft;

a first configuration lip roller;

a second actuator coupled to said lip roller support plate by a second linkage, said second actuator rotating said lip roller support plate to bring said first configuration lip roller into a position to contact the sheet material.

13. A roll forming apparatus for forming sheet material into multiple shapes, the roll forming apparatus comprising:

a leg forming apparatus having:

a first leg roller assembly having a first leg roller; and a convertible leg roller assembly including;

a support plate pivotally mounted on a shaft;

a first configuration leg roller;

an actuator coupled to said support plate by a linkage, said actuator rotating said support plate to bring said first configuration leg roller into a position to contact the sheet material;

wherein said support plate includes a second configuration leg roller, said actuator toggling said support plate to bring one of said first configuration leg roller or said second configuration leg roller into a position to contact the sheet material; and a lip forming apparatus having:

a first lip roller assembly having a first lip roller; and a convertible lip roller assembly opposite said first lip roller assembly;

said convertible lip roller assembly including:

a lip roller support plate pivotally mounted on a shaft;

a first configuration lip roller;

a second actuator coupled to said lip roller support plate by a second linkage, said second actuator rotating said lip roller support plate to bring said first configuration lip roller into a position to contact the sheet material.

14. The roll forming apparatus of claim 13 wherein:

first configuration leg roller is on a first side of said support plate and said second configuration leg roller is on a second side of said support plate.

15. The roll forming apparatus of claim 13 wherein:

said first roller assembly is fixed roller assembly.

* * * * *